US008233650B2

(12) United States Patent
Dreβler et al.

(10) Patent No.: US 8,233,650 B2
(45) Date of Patent: Jul. 31, 2012

(54) MULTI-STAGE ESTIMATION METHOD FOR NOISE REDUCTION AND HEARING APPARATUS

(75) Inventors: Oliver Dreβler, Fürth (DE); Wolfgang Sörgel, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 547 days.

(21) Appl. No.: 12/381,863

(22) Filed: Mar. 17, 2009

(65) Prior Publication Data

US 2009/0252358 A1 Oct. 8, 2009

(30) Foreign Application Priority Data

Apr. 7, 2008 (DE) ..... 10 2008 017 550

(51) Int. Cl.
*H04R 25/00* (2006.01)

(52) U.S. Cl. ..... 381/317; 381/71.1; 704/225; 704/233

(58) Field of Classification Search ..... 395/2.35; 702/77; 381/310–321, 71.1, 71.5, 71.6, 71.12; 704/225, 233

See application file for complete search history.

(56) References Cited

U.S. PATENT DOCUMENTS 4,185,168 A 1/1980 Graupe et al.
5,768,473 A * 6/1998 Eatwell et al. ..... 704/226
6,088,668 A * 7/2000 Zack ..... 704/225
6,108,610 A * 8/2000 Winn ..... 702/77
6,351,731 B1 * 2/2002 Anderson et al. ..... 704/233

FOREIGN PATENT DOCUMENTS

DE 69632626 T2 6/2005

OTHER PUBLICATIONS

Quatieri et al., "Speech Enhancement Based on Auditory Spectral Change", Lincoln Laboratory, Lexington , MA , IEEE 2002, pp. I-257-I-260.

Rangachari et al., "A noise-estimation algorithm for highly non-stationary environments", Speech Communications, Elsevier, 2004, pp, 220-231 Speech Communication; Others; 2004.

Martin, IEEE Transactions on Speech and Audio Processing, "Noise Power Spectral Density Estimation Bawed on Optimal Smoothing and Minimum Statistics", Jul. 2001, pp. 504-512, vol. 9, No. 5.

* cited by examiner

*Primary Examiner* — Matthew E Warren
*Assistant Examiner* — Fang-Xing Jiang

(57) ABSTRACT

The noise reduction for signals which can contain speech at least part of the time is to be improved. To this end a hearing apparatus and especially a hearing device with a first estimation device for estimating a first value of an input signal with a first estimation algorithm and a noise reduction device for reducing noise in the input signal are provided. A second estimation device, which is parameterized with the estimated first value, is used for estimating a second value of the input signal with a second estimation algorithm. The noise reduction device receives the estimated second value from the second estimation device for reducing the noise. The two-stage estimation method enables an adaptive estimation to be carried out which is always currently adapted to an input signal.

14 Claims, 2 Drawing Sheets

MULTI-STAGE ESTIMATION METHOD FOR NOISE REDUCTION AND HEARING APPARATUS

CROSS REFERENCE TO RELATED APPLICATIONS

This application claims priority of German application No. 10 2008 017 550.1 filed Apr. 7, 2008, which is incorporated by reference herein in its entirety.

FIELD OF INVENTION

The present invention relates to a method of noise reduction for hearing apparatuses by estimating a value of an input signal with an estimation algorithm. In addition the present invention relates to a corresponding hearing apparatus with an estimation facility for estimating a value of an input signal with an estimation algorithm and a noise reduction device for reducing noise in the input signal. The term "hearing apparatus" here is to be understood as any device outputting sound worn in or on the ear, especially a hearing device, a headset, headphones and such like.

BACKGROUND OF INVENTION

Hearing devices are wearable hearing apparatuses used to assist those with impaired hearing. To meet the numerous individual requirements different designs of hearing device are provided, such as behind-the-ear (BTE) hearing devices, receiver-in-the-canal (RIC) hearing devices, in-the-ear (ITE) hearing devices and also Concha or in-canal (ITE, CIC) hearing devices. The typical hearing devices mentioned are worn on the outer ear or in the auditory canal. Above and beyond these designs however there are also bone conduction hearing aids, implantable or vibro-tactile hearing aids available on the market. In such hearing aids the damaged hearing is simulated either mechanically or electrically.

Hearing devices principally have as their main components an input converter, an amplifier and an output converter. The input converter is as a rule a sound receiver, e.g. a microphone, and/or an electromagnetic receiver, e.g. an induction coil. The output converter is mostly implemented as an electroacoustic converter, e.g. a miniature loudspeaker or as an electromechanical converter, e.g. bone conduction earpiece. The amplifier is usually integrated into a signal processing unit. This basic structure is shown in FIG. 1, using a behind-the-ear hearing device as an example. One or more microphones 2 for recording the sound from the surroundings are built into a hearing device housing 1 worn behind the ear. A signal processing unit 3, which is also integrated into the hearing device housing 1, processes the microphone signals and amplifies them. The output signal of the signal processing unit 3 is transmitted to a loudspeaker or earpiece 4 which outputs an acoustic signal. The sound is transmitted, if necessary via a sound tube, which is fixed with an otoplastic in the auditory canal, to the hearing device wearer's eardrum. The power is supplied to the hearing device and especially to the signal processing unit 3 by a battery 5 also integrated into the hearing device housing 1.

In the processing of digital speech recording, e.g. digital hearing devices, it is often desirable to suppress disruptive background noise without influencing the useful signal (speech). There are known filter methods suitable for this purpose which influence the short-term spectrum of the signal, such as the Wiener filter. However these methods require a precise estimation of the frequency-dependent power of the noise to be suppressed from an input signal. If this estimation is imprecise, either an unsatisfactory noise suppression is achieved, the desired signal is affected or additional artificially-created noise signals, so called "musical tones" occur. There are no methods for noise estimation yet available which solve these problems completely and efficiently.

Previously noise power has been able to be estimated principally using two approaches. Both methods can be undertaken either over a wide bandwidth or preferably in a frequency range split up by means of a filter bank or short-term Fourier transformation:

1. Speech Activity Detection:

Provided no speech activity is detected, the complete (time-variable) input signal power is regarded as noise. If speech activity is detected, the noise estimation is kept constant at the last value before the onset of the speech activity.

2. Noise Power Estimation During Speech Activity (the so Called "Minimum Tracking Method"):

It is known that during speech activity the speech signal power in individual frequency ranges is repeatedly briefly almost zero. If there is now an underlying mixture of speech and noise changing comparatively slowly over time, the minima of the spectral signal power considered over time correspond to the noise power at these times. The noise signal power must lie between the established minima (minimum tracking). Such a minimum tracking can for example be performed with the aid of a smoothing filter, which is described for example in R. Martin, "Noise power spectral density estimation based on optimal smoothing and minimum statistics", IEEE Trans. Speech Audio Processing, Vol. 5, July 2001, Pages 504-512 or S. Rangachari, P. Loizou, "A noise-estimation algorithm for highly non-stationary environments", Speech Communication, Vol. 48, February 2006, Pages 220-231. The noise power is typically determined separately for different frequency ranges in the input signal. To this end the input signal is first split up by means of a filter bank or a Fourier transformation into individual frequency components. These components are then processed separately from one another.

SUMMARY OF INVENTION

In the above method 1, on the one hand the reliable detection of speech activity represents a problem, and on the other hand it is not possible to track noise which varies over time during simultaneous speech activity.

In the above method 2 there are fundamental contradictions in the setting of the algorithm to be resolved: If speech is present the noise estimation should only be adapted slowly in order not to classify speech components as noise through fast adaptation and affect the speech quality in this way. If there is no speech present, the noise power estimation should follow the temporal fine structure of the input signal without any delay. This produces conflicting demands for the setting parameters of the method, such as smoothing time constants, window length for a minimum search or weighting factors, which to date have only been able to be resolved averagely optimally.

The object of the present invention consists of improving the quality of noise suppression, so that speech in particular is less affected and disruptive artifacts can be better avoided.

Inventively this object is achieved by a method for noise reduction for hearing apparatuses by estimating a first value of an input signal with a first estimation algorithm, parameterizing a second estimation algorithm with the estimated first value, estimating a second value of the input signal with the second estimation algorithm and reducing noise in the input signal based on the estimated second value. In the invention here and in the following text the first value can be equal to the second value.

In addition the invention provides for a hearing device or a hearing apparatus with a first estimation device for estimating a first value of an input signal with a first estimation algorithm and a noise reduction device for reducing noise in the input signal as well as comprising a second estimation device which is parameterized with the estimated first value, for estimating a second value of the input signal with a second estimation algorithm, with the noise reduction device receiving the estimated second value from the second estimation device for reducing the noise.

The inventive two-stage estimation leads to a markedly improved estimation quality, since in the first stage a simple estimation can be carried out, of which the result is included for parameterization of the second estimation device or of the second estimation algorithm. The second estimation algorithm can be adapted in this way to a specific noise situation, which allows a situation-specific estimation to be achieved.

The first estimation algorithm can be based on a minimum tracking method. This enables a noise power level to be estimated in a simple manner for speech activity.

In a specific embodiment a rate of change of the input signal over time can be estimated by the first estimation algorithm as a first or further value for parameterizing the second estimation algorithm. In this way the overall power and the noise power can be reliably estimated.

In accordance with a further embodiment the first estimation algorithm and the second estimation algorithm can be structurally the same. This reduces the implementation effort. In particular it is possible in this way for the first estimation device and the second estimation device to be implemented by a single estimation device, which operates alternately in time division multiplexing mode as the first and second estimation device.

The two estimation algorithms can also be different however. Thus the first estimation algorithm can include a recursive smoothing and the second estimation algorithm can be non-recursive. In this way the implementation effort can be adapted to the desired estimation quality.

Preferably the first value which is estimated with the first estimation algorithm of the first estimator is a noise estimation comprising a signal power SP1, and a noise power NP1, or a signal-to-noise ratio. These variables can be included directly for attenuation of corresponding noise.

Furthermore a first value can be estimated selectively in each case by the first estimation algorithm for a number of frequency ranges and these first values combined in order to parameterize the second estimation algorithm. It is thus possible to influence the parameterization of the second estimation algorithm on the basis of the spectral distribution of the input signal.

Especially preferable is the dynamic parameterization of the second estimation algorithm with a constantly updated first value of the first estimation algorithm. This means that the noise reduction can always be continuously adapted to the current acoustic situation with high quality.

Furthermore, with the described method of noise reduction it can also be expedient to split the input signal into individual frequency components and to process it in relation to the non-split signal in a temporally downsampled form. With this downsampling the computing effort can be greatly reduced.

BRIEF DESCRIPTION OF THE DRAWINGS

The present invention is explained in greater detail with reference to the enclosed drawings, which show.

DETAILED DESCRIPTION OF INVENTION

The exemplary embodiments described in greater detail below represent preferred embodiments of the present invention.

Figure 1:
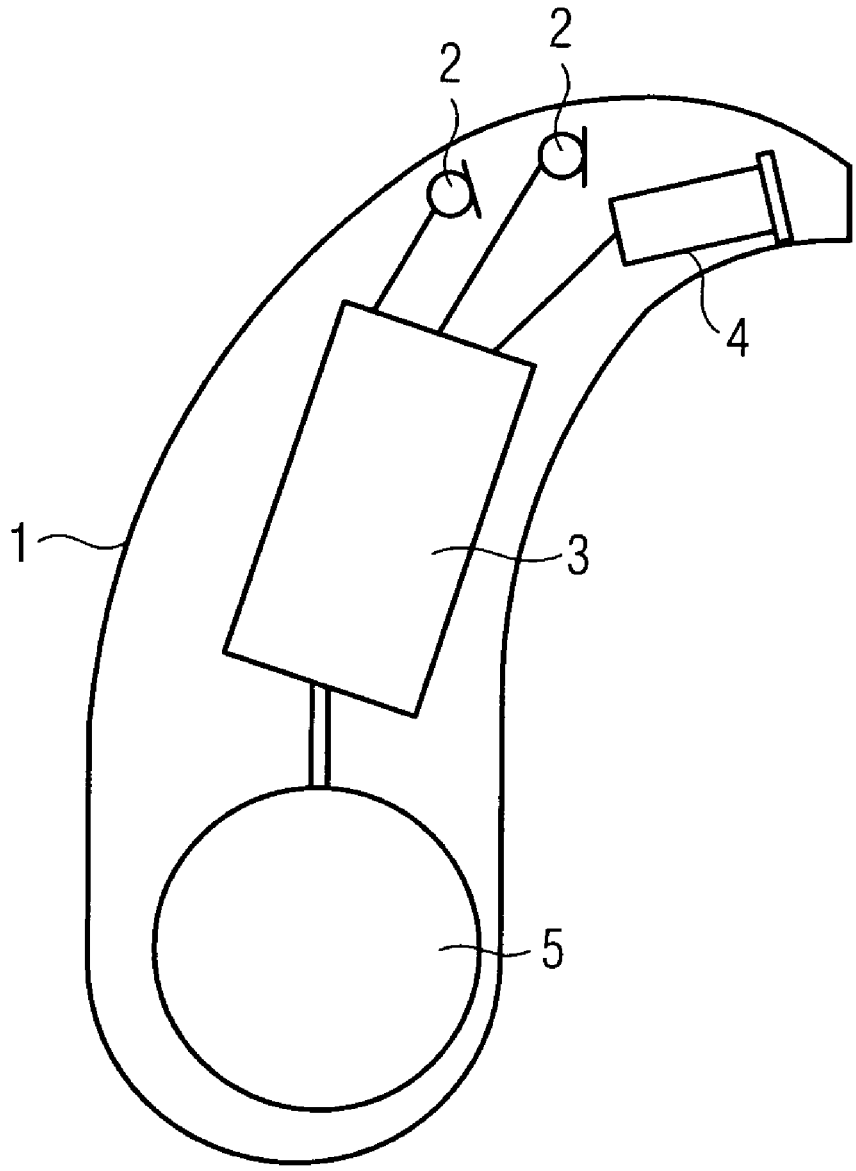
FIG 1 (Prior art)
FIG. 1 the basic structure of a hearing device in accordance with the prior art and FIG. 2 a block diagram of a form of implementation of an inventive method.
Figure 2:
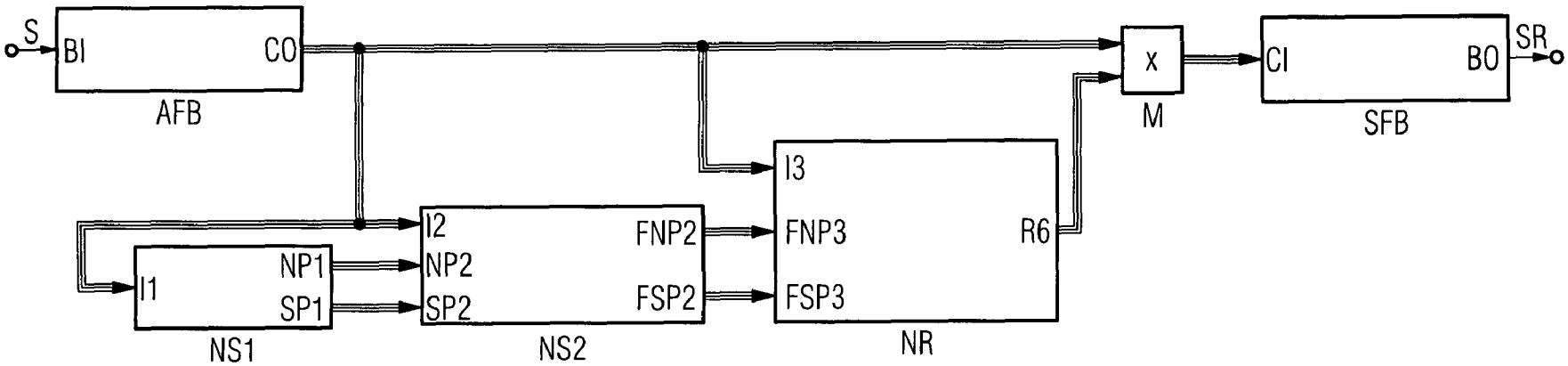

The signal processing device of a hearing device shown in FIG. 2 possesses an analysis filter bank AFB at its signal input. It has a broadband signal input BI and a multichannel output CO. A noisy useful signal S is injected into the broadband input BI. This signal is broken down spectrally by the analysis filter bank AFB. The output signal of the analysis filter bank AFB is fed to the input I1 of a first estimator NS1, to an input I2 of a second estimator NS2 and to an input I3 of a noise reduction device NR. The first estimator NS1 estimates a noise estimation comprising a signal power SP1 and a noise power NP1, or a signal-to-noise ratio. The power of the noise signal it is output as initial noise power at output NP1. The useful signal is output at the output SP1.

The second estimator NS2, in addition to the output signal of the analysis filter bank AFB, accepts the initial noise signal power at its input NP2 and the initial useful signal power at its input SP2. The initial noise signal power and the initial useful signal power are used for parameterization of the adaptive estimator NS2 which outputs a final value comprising a final noise estimation comprising a final signal power FSP2 and a noise power FNP2. With the current parameter setting the second estimator estimates this final noise signal power which it outputs at its output FNP2 and optionally also this final useful signal power which it outputs at its output FSP2.

The noise signal reduction device connected downstream from the adaptive second estimator NS2, which for example can be implemented as a Wiener filter, accepts the final noise signal power at its input FNP3 and the final useful signal power at its input FSP3. On the basis of these variables, together with the output signal of the analysis filter bank AFB, the noise reduction algorithm of the noise reduction device NR calculates an attenuation or reduction gain which is output at the output RG.

The preferably multichannel reduction gain of the noise reduction device NR is fed together with the multichannel output signal of the analysis filter bank to a multiplier M which executes a multiplication channel-by-channel, so that a multichannel signal free of noise is produced which is fed to a synthesis filter bank SFB, specifically to its multichannel input CI. The synthesis filter bank SFB synthesizes the signals of the individual channels into a broadband noise-reduced output signal SR. This signal is available at the output BO.

The removal of noise is based on a two-stage estimation of the noise signal power. In this case a first estimation of the overall power or of the useful signal power and of the noise power is first carried out in the first estimator NS1. This first estimation can be carried out for example by means of a fixed parameterized minimum tracking method, as has been described above. For example the rate of change over time of the input signal can be used as an (if necessary additional) criterion for the estimation. This rate of change is described in the article by F. F. Quatieri, R. B. Dunn, "Speech enhancement based on auditory spectral change", Proc. IEEE Int. Conf. Acoustics, Speech, Signal Processing (ICASSP), Vol. I, 2002, Pages 257 to 260 under the keyword "spectral change".

As a result of this noise estimation by the first estimator NS1, e.g. in the form of a signal-to-noise ratio (or in a preferred embodiment in the form of a noise-to-signal ratio or of the signal power SP1 or the noise power NP1 directly, operating parameters of the second noise estimation method operated in parallel to the first noise estimation method are adapted in the second estimator NS2.

In a preferred embodiment the second noise estimation method is structurally the same as the first and differs only in the parameterization changed adaptively on the basis of the result of the first method. In the second estimator for example a time constant of a smoother can be adapted so that for a low estimated signal-to-noise ratio a faster smoothing is carried out than for a high estimated signal-to-noise ratio.

Furthermore in the second estimator NS2, based on the estimation variables from the first estimator, not just one parameter but also a number of parameters can be changed. The parameters of the second noise power estimator NS2 can be changed directly, depending on frequency, in accordance with the first estimation of the noise power. Alternatively the parameters of the second noise power estimator can also be changed on the basis of a combination of the original frequency-selectively determined first noise power estimation. In such cases the change ranges and limit values of the parameters of the second noise estimator NS2 can be determined as a function of frequency. It is especially advantageous for the change ranges and limit values of the second noise estimator NS2 to be determined dynamically as a function of the first estimation.

The second noise estimation method or the second noise estimator can also differ structurally from the first. Thus for example in the first method a recursive smoothing (cf. R. Martin ibid.) can be used, while in the second a non-recursive method (cf. S. Rangachari, P. Loizou ibid.) can be adapted or vice versa.

The input signal can be split up into frequency components either by means of a (also non-uniform) filter bank or by means of (short-term) Fourier transformation. Furthermore the signal split up into individual frequency components can be processed in relation to the non-split-up signal in temporal downsampled form.

The inventive combination of a first fixed parameterized noise estimator with a second noise estimator parameterized temporally-variably on the basis of estimated values of the first estimator and if necessary further criteria enables a noise estimation to be implemented which does not have the disadvantageous features of a fixed parameterized noise estimator and does not demand the explicit estimation of speech activity. In particular no compromise needs to be found between slow adaptation if a speech signal is present and fast adaptation if no speech is present. Instead the adaptation of the parameters overall enables an improved noise estimation to be achieved which has less of an effect on speech and simultaneously significantly reduces noise artifacts such as "musical tones". Simultaneously the proposed solution can be efficiently implemented, e.g. by a single noise estimator operated in time division multiplexing mode, which allows its use in devices with low signal processing capacity, such as hearing devices for example.

The invention claimed is:

1. A method for noise reduction for hearing apparatuses by a signal processing device, comprising:

implementing a two-stage noise estimation comprising:

receiving an input signal by a first noise estimator;

estimating a first value by the first noise estimator comprising a noise estimation with a first estimation algorithm;

receiving the input signal and the first value by a second noise estimator;

estimating a final value by the second noise estimator comprising a final noise estimation by a second estimation algorithm that dynamically adapts operating parameters of the second noise estimator to a current acoustic situation based on the first value;

receiving the input signal and the final value by a noise reduction device for calculating a reduction gain for reducing noise in the input signal based on the final value.

2. The method as claimed in claim 1, wherein the first estimation algorithm is based on a minimum tracking method.

3. The method as claimed in claim 1, further comprising estimating a rate of change of the input signal over time by the first estimation algorithm as a further value for parameterizing the second estimation algorithm.

4. The method as claimed in claim 1, wherein the first and second estimation algorithms are structurally the same, thereby allowing implementation on a single estimation device using time division multiplexing.

5. The method as claimed in claim 1, wherein the first estimation algorithm includes a recursive smoothing and the second estimation algorithm not being recursive.

6. The method as claimed in claim 1, wherein the first estimation algorithm determines a signal power, a noise power or a signal-to-noise ratio as part of the noise estimation.

7. The method as claimed in claim 1, wherein the first estimation algorithm estimates noise estimations for a select plurality of frequency ranges which are combined to form a combined first value, and wherein the second estimation algorithm receives the combined first value thereby dynamically adapting the operating parameters on a basis of spectral distribution of the input signal.

8. The method as claimed in claim 1, wherein the second estimation algorithm receives a constantly updated first value and wherein the second value is dynamically updated based on the constantly updated first value.

9. The method as claimed in claim 1, wherein the input signal is split into individual frequency components and processed in relation to the non-split signal in a temporally downsampled form.

10. A hearing apparatus, comprising:

two-stage noise estimation device comprising:

a first estimation device for estimating a first value of an input signal with a first estimation algorithm, the first value comprising a noise estimation;

a second estimation device receiving the first value and the input signal for estimating a final value comprising a final noise estimation with a second estimation algorithm, wherein the second estimation algorithm dynamically adapts its operating parameters to a current acoustic situation based on the first value, and a noise reduction device for calculating a reduction gain and reducing noise in the input signal, the noise reduction device receiving the input signal and the final value comprising the final noise estimation from the second estimation device for reducing the noise.

11. A hearing apparatus comprising, a two-stage noise estimation device comprising:

a first estimation stage for estimating a first value of an input signal with a first estimation algorithm, the first value comprising a noise estimation;

a second estimation stage receiving the first value and the input signal for estimating a final value comprising a final noise estimation with a second estimation algorithm, wherein the second estimation algorithm dynamically adapts its operating parameters to a current acoustic situation based on the first value, and a noise reduction device for calculating a reduction gain and reducing noise in the input signal, the noise reduction device receiving the input signal and the final value comprising the final noise estimation from the second estimation device for reducing the noise, wherein the first and second estimation stages are implemented by a single estimation device which is able to be operated in time division multiplexing mode alternately as the first and second estimation stages.

12. The hearing apparatus as claimed in claim 10, wherein the first estimation algorithm is based on a minimum tracking method.

13. The hearing apparatus as claimed in claim 10, wherein the first estimation algorithm further estimates a rate of change of the input signal over time as a further value for parameterizing the second estimation algorithm.

14. The hearing apparatus as claimed in claim 10, wherein the first estimation algorithm includes a recursive smoothing and the second estimation algorithm not being recursive.

* * * * *